US009359837B2

(12) United States Patent
Poehner

(10) Patent No.: US 9,359,837 B2
(45) Date of Patent: Jun. 7, 2016

(54) MULTI CAPACITY RISER TENSIONERS

(71) Applicant: MHWIRTH AS, Kristiansand (NO)

(72) Inventor: Lars Poehner, Horten (NO)

(73) Assignee: MHWIRTH AS, Kristiansand (NO)

( * ) Notice: Subject to any disclaimer, the term of this patent is extended or adjusted under 35 U.S.C. 154(b) by 0 days.

(21) Appl. No.: 14/650,314

(22) PCT Filed: Dec. 5, 2013

(86) PCT No.: PCT/EP2013/075666

§ 371 (c)(1),
(2) Date: Jun. 8, 2015

(87) PCT Pub. No.: WO2014/090682

PCT Pub. Date: Jun. 19, 2014

(65) Prior Publication Data

US 2015/0300102 A1 Oct. 22, 2015

(30) Foreign Application Priority Data

Dec. 10, 2012 (NO) ..... 20121487

(51) Int. Cl.
*E21B 19/00* (2006.01)
*E02B 17/08* (2006.01)
*E21B 19/09* (2006.01)

(52) U.S. Cl.
CPC ..... *E21B 19/006* (2013.01); *E02B 17/0809* (2013.01); *E21B 19/002* (2013.01); *E21B 19/09* (2013.01)

(58) Field of Classification Search
CPC . E02B 17/0809; E21B 19/002; E21B 19/006; E21B 19/09
USPC ..... 166/335, 354, 355
See application file for complete search history.

(56) References Cited

U.S. PATENT DOCUMENTS

| | | | | |
|---|---|---|---|---|
| 3,902,319 | A | 9/1975 | Olmsted | |
| 4,351,261 | A | 9/1982 | Shanks | |
| 4,362,438 | A | 12/1982 | Spink | |
| 4,487,150 | A | 12/1984 | Shanks | |
| 4,615,542 | A * | 10/1986 | Ideno | E21B 17/01 166/352 |
| 4,886,397 | A | 12/1989 | Cherbonnier | |

(Continued)

FOREIGN PATENT DOCUMENTS

| | | | | |
|---|---|---|---|---|
| GB | 2 109 036 | A | 5/1983 | |
| NL | 8403871 | A | 7/1986 | |
| NO | WO 2008051092 | A1 * | 5/2008 | E21B 19/006 |

*Primary Examiner* — James G Sayre
(74) *Attorney, Agent, or Firm* — Norman B. Thot

(57) ABSTRACT

A hydraulic cylinder unit for connection to a wire line riser tensioner system includes a hydraulic cylinder comprising a cylinder piston separating a first cylinder chamber from a second cylinder chamber. A low pressure tank is arranged as a closed cylinder. A first conduit is inserted into the closed cylinder and provides a fluid communication between the low pressure tank and the first cylinder chamber. A second conduit provides a fluid communication between a high pressure fluid reservoir and the second cylinder chamber. A feedback conduit provides a fluid communication between the first cylinder chamber and the second cylinder chamber. A valve element comprising at least one valve is configured to be in a fluid communication with the at least one first conduit and the at least one feedback conduit. The valve element is configured to provide a reversible switching between a first alternative configuration and a second alternative configuration.

12 Claims, 4 Drawing Sheets

(56) References Cited

U.S. PATENT DOCUMENTS 5,050,380 A * 9/1991 Jonsson ..... F15B 3/00 417/349
5,209,302 A 5/1993 Robichaux et al.
5,846,028 A 12/1998 Thory
8,251,148 B2 * 8/2012 von der Ohe ..... B63B 39/00 166/355
2008/0304916 A1 12/2008 Crotwell et al.
2015/0184470 A1 * 7/2015 Megens ..... E21B 19/006 166/355

* cited by examiner

MULTI CAPACITY RISER TENSIONERS

CROSS REFERENCE TO PRIOR APPLICATIONS

This application is a U.S. National Phase application under 35 U.S.C. §371 of International Application No. PCT/EP2013/075666, filed on Dec. 5, 2013 and which claims benefit to Norwegian Patent Application No. 20121487, filed on Dec. 10, 2012. The International Application was published in English on Jun. 19, 2014 as WO 2014/090682 A2 under PCT Article 21(2).

FIELD

The present invention relates generally to the field of floating offshore platforms or vessels for the exploitation of undersea deposits of petroleum and natural gas. The present invention more specifically relates to a system and to an apparatus for multi capacity riser tensioners that extend from a subsea wellhead or subsurface structure to a floating platform or vessel.

BACKGROUND

Offshore platforms for the exploitation of undersea petroleum and natural gas deposits typically support production risers that extend to the platform from one or more wellheads or structures on the seabed. In deep water applications, floating platforms (such as spars, tension leg platforms, extended draft platforms and semi-submersible platforms) are typically used. These platforms are subject to motion due to wind, waves and currents. The risers employed with such platforms must therefore be tensioned to permit the platform to move relative to the risers. Riser tension must also be maintained so that the riser does not buckle under its own weight. The tensioning mechanism must accordingly exert a substantially continuous tension force to the riser within a well-defined range.

Hydro-pneumatic tensioner systems are one form of riser tensioning mechanism typically used to support risers known as "Top Tensioned Risers" on various platforms. A plurality of passive hydraulic cylinders with pneumatic accumulators is connected between the platform and the riser to provide and maintain the necessary riser tension. Platform responses to the above mentioned environmental conditions, mainly heave and horizontal motions, create changes in riser length relative to the platform, causing the tensioning cylinders to stroke in and out. The spring effect resulting from the gas compression or expansion during riser stroke partially isolates the riser from the low heave platform motions. For horizontal (or drift off) motions, the compression of gas causes a load variation on the tensioning cylinders that is similar to that of the heave motions.

Hydraulic cylinders constituting such hydro-pneumatic tensioning systems comprise pistons in which the piston rods are at least indirectly connected to the riser so that the pressure induced movements of the piston relative to its cylinder results in the desired riser tensioning.

Such hydro-pneumatic tensioner systems are presently produced in a variety of dimensions/sizes, each corresponding to a certain load capacity (further detailed below). Examples of typical state of the art riser tensioner systems are described in U.S. Pat. Nos. 4,886,397, 3,902,319, GB 2,109,036 and U.S. Pat. No. 5,846,028 A.

The above prior art tensioner systems all constitute systems designed for a particular load capacity. There is normally space for just one tensioning system size on a drilling rig/floating platform, hence setting a clear limitation of the available load capacity range. During the design of a rig, the designer, having knowledge of these prior art systems, takes into account which type of operation the rig must perform, and then chooses the tensioning systems based on the maximum requirement for that particular rig. The criteria for choice of rig, and thereby tensioning size, may be sea depths, mud weight, riser type, and task. The latter normally varies from e.g., wildcat drilling requiring large dimensional systems to e.g., workover or production testing requiring significantly less riser tensioning capacity. The need for riser tensioning may be as little as 10% of maximum capacity of the installed riser tensioner. In these cases, the largest and heaviest tensioner systems are generally unsuitable since the relatively large load variations introduce risks such as fatigue on the wellhead and/or on the riser.

FIGS. 2, A and B shows prior art drawings of two different cylinders presently used in the industry. The effective cross section of the cylinder piston 2, being composed of a piston rod 2' and a piston head 2" and slidingly journaled within the cylinder 1, determines, in addition to the net pressure difference across the piston head 2", the total force (F=pA) exerted onto the cylinder piston 2 and thereby on the riser in question (not shown). A gas pressure source and a suitable high-pressure pneumatic accumulator 5 allow at least some control of the piston movement induced cylinder pressure.

To provide correct capacity for the various rig requirements during design, two alternative arrangements have primarily been chosen; single acting (FIG. 2 A) and double acting (FIG. 2 B). Each of these is described below.

Single acting: The simplest way of arranging the hydraulic cylinder in riser tensioning systems is as a so-called single acting cylinder, hereinafter referred to as a "plunger". In a plunger, the piston head 2" is normally seal free and comprises several piston perforations 6 perforating the piston head 2", thereby equalizing the pressure (P) above and below the piston head 2. When the piston 2 is displaced within the cylinder 1, the cylinder fluid located therein flows through perforations 6. The effective cross section (A) of the piston 2 is therefore equal to the effective radial cross section of the piston rod 2'. The required fluid pressure within the cylinder 1 is provided by a single high-pressure accumulator 5 being in fluid communication with the cylinder 1 via a high pressure conduit 8. The high pressure accumulator 5 is further typically divided into a high pressure gas end 5' and a high pressure fluid end 5" by a floating piston 7, where the high pressure conduit 8 is connected to the high pressure fluid end 5". To provide the necessary pressure on the high pressure gas end 5', and thereby causing the desired compression of the fluid in the high pressure fluid end 5" by the resulting translational movement of the floating piston 7, a gas bank (not shown) is connected in fluid communication via a high pressure gas conduit 9 to the high pressure gas end 5'.

Dual acting: FIG. 2 B shows an alternative hydraulic cylinder in a prior art riser tensioning system; a dual acting cylinder. As for the plunger, the dual acting system comprises a compressed cylinder 1 with a piston 2,2',2", a high-pressure accumulator 5,5',5", a floating piston 7, a high pressure conduit 8, and a high pressure gas conduit 9. In contrast to the plunger arrangement, however, the piston head 2" in a dual acting cylinder forms a fluid tight separation with the inside walls of the cylinder 1, thereby effectively dividing the cylinder 1 into two mutually fluid tight chambers; a first cylinder chamber 1' and a second cylinder chamber 1". The separation may be achieved by arranging one or more piston seals 20 between the inner wall of the cylinder and the circumference of the piston head 2". To be able to control the pressure in the first cylinder chamber 1', i.e., on the piston rod 2' side, a pressure source, such as a low pressure accumulator 10, is connected in fluid communication with the first cylinder chamber 1' via a low pressure conduit 11. In FIG. 2 B, this low pressure accumulator 10 is illustrated as a partly fluid filled container into which an open end of a low pressure fluid conduit 11 is inserted. The pressure formed in the first cylinder chamber 1' must be low enough to avoid that the pressure force set up in the second cylinder chamber 1", due to the above mentioned high-pressure accumulator 5,5',5", is not significantly counteracted. For further details about dual acting systems, see, for example, US 2008/0304916 A1.

Tensioning systems applying these two types of hydraulic cylinders provide tensioning of risers that covers the two capacity requirements mentioned above. More specifically, the plunger type and the dual acting type may successfully be applied for low capacity requirements such as workover or production testing and high capacity requirements such as wildcat drilling. As indicated previously, there is a need, however, for a riser tensioner system which may handle the above mentioned variations of the drilling rig requirements without introducing any significant operational risks such as fatigue on the wellhead and/or the riser.

Various tensioner systems have been disclosed which are able to handle capacity variations. One example is U.S. Pat. No. 4,362,438 which describes a tensioner system having at least two hydraulic cylinders connected to the riser in question. The purpose of the solution described in U.S. Pat. No. 4,362,438 is to redistribute total pressure among any remaining functional hydraulic cylinders to maintain constant riser tensioning in case of undesired pressure changes, such as the failure in one or more cylinders. It therefore does not provide a system that allows a change between a large, high capacity, system and a small, low capacity system. Another example is U.S. Pat. No. 4,351,261 which describes a heave compensation system that adjusts to various operations with different requirements for load equalization by means of switching between several high pressure accumulators. This solution also does not allow a change between a large system having high capacity and a small system having low capacity. All the above mentioned publications therefore disclose solutions to problems which differ significantly from the problem of the present invention, i.e., to handle large capacity variations due to predictable changes in drilling rig requirements.

SUMMARY

An aspect of the present invention is to provide a cylinder assembly for connection to a riser tensioning system that overcomes the above mentioned disadvantages, that is, to provide a stable and easy operational tensioning assembly that enables switching between two fully functional systems, each exhibiting tensioning capacities covering different ends of the pre-calculated capacity range, for example, from below 10% and up to 100% of the riser tensioning capacity requirement expected throughout a rig's estimated lifetime.

In an embodiment, the present invention provides a hydraulic cylinder unit for connection to a wire line riser tensioner system which includes a hydraulic cylinder comprising a first cylinder chamber, a second cylinder chamber and at least one cylinder piston arranged to separate the first cylinder chamber from the second cylinder chamber. The at least one cylinder piston comprises a piston rod and a piston head. A low pressure tank is arranged as a closed cylinder so as to comprise a desired pressure. At least one first conduit is inserted into the closed cylinder of the low pressure tank and configured to provide a fluid communication between the low pressure tank and the first cylinder chamber. At least one second conduit is configured to provide a fluid communication between a high pressure fluid reservoir and the second cylinder chamber. At least one feedback conduit is configured to provide a direct fluid communication between the first cylinder chamber and the second cylinder chamber. A valve element comprises at least one valve. The valve element is configured to be in a fluid communication with the at least one first conduit and the at least one feedback conduit. The valve element is configured to provide a reversible switching between a first alternative configuration and a second alternative configuration. The first alternative configuration comprises a first fluid obstruction between the low pressure tank and the first cylinder chamber, and a first fluid communication between the first cylinder chamber and the second cylinder chamber via the at least one feedback conduit. The second alternative configuration comprises a second fluid obstruction between the first cylinder chamber and the second cylinder chamber, and a second fluid communication between the low pressure tank and the first cylinder chamber via the at least one first conduit. The present invention thereby applies the principal idea of switching between a system through which a relatively small amount of fluids flow, resulting in a correspondingly small gas compression, and a system through which a relatively large amount of fluids flow, resulting in a correspondingly large fluid compression.

The present invention also provides a method for switching a hydraulic cylinder unit between a hydraulic cylinder unit with low tension capabilities and a hydraulic cylinder unit with high tension capabilities and a wire line riser tensioning system for a riser connected to a floating platform.

BRIEF DESCRIPTION OF THE DRAWINGS

The present invention is described in greater detail below on the basis of embodiments and of the drawings in which.

DETAILED DESCRIPTION

Figure 1:
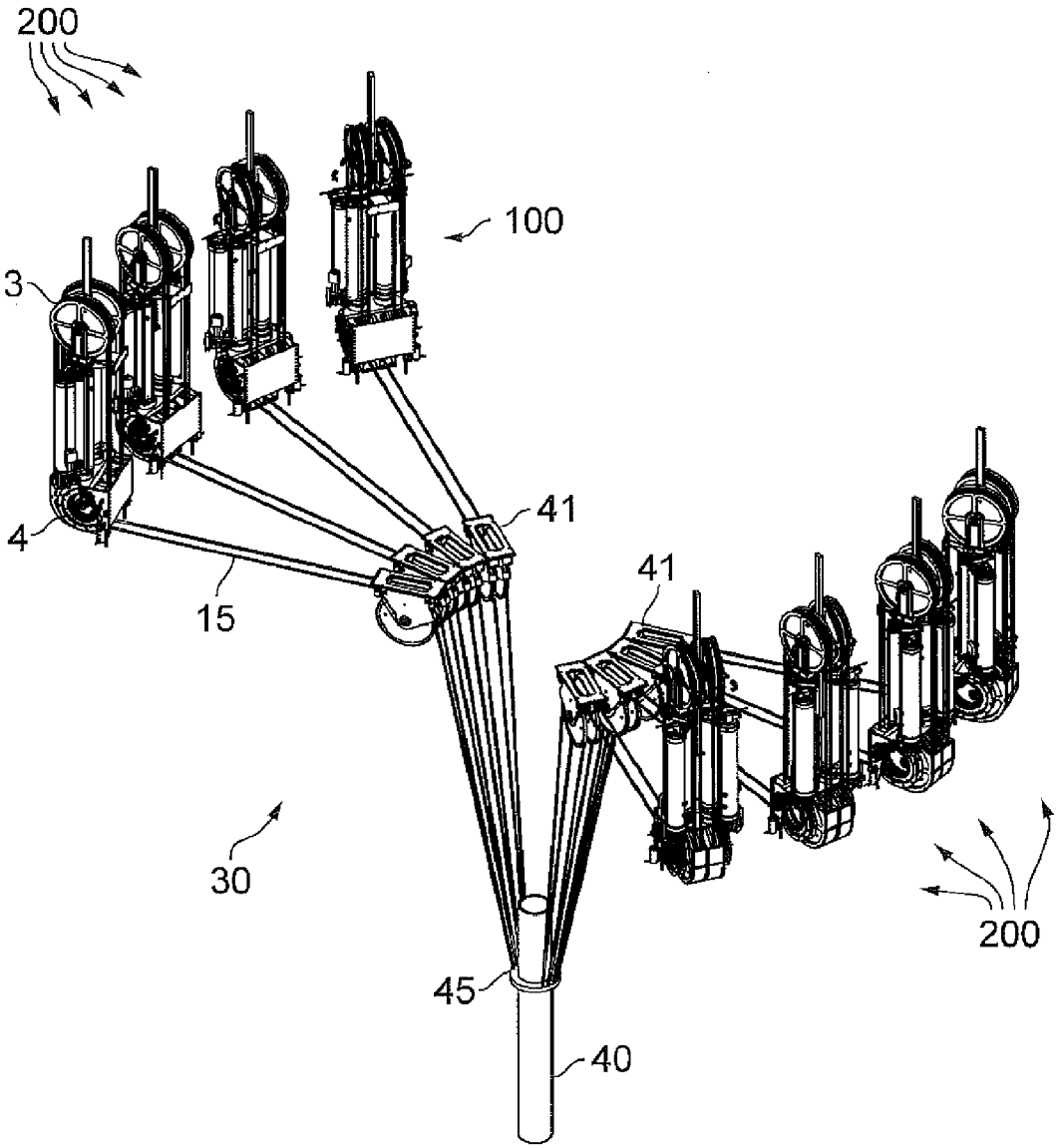
Fig. 1 (PRIOR ART)
FIG. 1 shows a perspective view of a wire line riser tensioning system comprising a multiple of hydraulic cylinder assemblies in accordance with the prior art.

In an embodiment, the present invention provides a hydraulic cylinder unit for connection to a riser tensioner system, comprising:

- a piston cylinder being separated in a first cylinder chamber and a second cylinder chamber by at least one piston comprising a piston rod and a piston head,
- a low pressure tank,
- at least one first conduit or low pressure conduit being arranged to provide a fluid communication element between the low pressure tank and the first cylinder chamber,
- a high pressure fluid reservoir, and
- at least one second conduit or high pressure conduit being arranged to provide a fluid communication element between the high pressure fluid reservoir and the second cylinder chamber.

In an embodiment of the present invention, the inventive cylinder unit further comprises:

at least one feedback conduit being arranged to provide a fluid communication element between the first cylinder chamber and the second cylinder chamber, and a valve element being arranged at the at least one first conduit and the at least one feedback conduit to provide reversible switching between:

a first configuration, in which the valve element prohibits fluid communication between the low pressure tank and the first cylinder chamber via the at least one first conduit, and allows fluid communication between the first cylinder chamber and the second cylinder chamber via the at least one feedback conduit, and a second configuration, in which the valve element allows fluid communication between the low pressure tank and the first cylinder chamber via the at least one first conduit, and prohibits fluid communication between the first cylinder chamber and the second cylinder chamber via the at least one feedback conduit.

At least one of the valves constituting the valve element can, for example, be arranged in the at least one first conduit and may be either a three-way valve or at least two two-way valves, or a combination thereof. In the case of two-way valves, at least one valve may be arranged in fluid communication on the at least one first conduit, and at least one valve may be arranged in fluid communication on the at least one feedback conduit.

No restrictions exist with respect to the length of the above mentioned conduits. The present invention therefore also covers the embodiment in which the cylinder/tank/reservoir are arranged in immediate proximity to each other to allow the desired fluid communication.

In an embodiment of the present invention, the piston rod can, for example, be arranged in the first cylinder chamber.

For the receipt of a riser tensioning cable that is intended to be connected to one end of a riser during use, at least one first sheave or upper sheave can, for example, be arranged at one of the two axial sides of the piston cylinder, in addition to at least one second sheave or lower sheave arranged at the other of the two axial sides of the piston cylinder. In an embodiment of the present invention, at least two first sheaves and at least two second sheaves can, for example, be arranged at the two axial sides of the piston cylinder.

In an embodiment of the present invention, the high pressure fluid reservoir can, for example, be separated in a high pressure gas end and a high pressure fluid end by a reservoir piston, and the at least one second conduit or high pressure conduit provides a fluid communication element between the high pressure fluid end and the second cylinder chamber. This reservoir piston may be a floating piston.

The present invention also provides a method for switching a hydraulic cylinder unit between a hydraulic cylinder unit having properties that facilitate tensioning of risers with low tension requirements, for example, workover or production testing, and a hydraulic cylinder unit having properties that facilitate tensioning of risers with high tension requirements, for example, wildcat drilling. A skilled person will know what is considered low tension requirements and what is considered high tension requirements basedon the defined drilling task.

In an embodiment, the method of the present invention comprises two steps:

operating the valve element in a hydraulic cylinder unit in accordance with the specification above to allow fluid communication between the first cylinder chamber and the second cylinder chamber via the at least one feedback conduit, and simultaneously to prohibit fluid communication between the first cylinder chamber and the low pressure tank, and operating the valve element in a hydraulic cylinder unit in accordance with the specification above to prohibit fluid communication between the first cylinder chamber and the second cylinder chamber, and simultaneously to allow fluid communication between the first cylinder chamber and the low pressure tank. In the former step and the latter step, the hydraulic cylinder unit is configured as a unit with low tension capabilities (plunger) and high tension capabilities (dual acting), respectively.

The present invention also provides a wire line riser tensioning system for a riser connected to a floating platform. The inventive system comprises a multiple of individually operated hydraulic cylinder assemblies comprising at least one hydraulic cylinder unit in accordance with the specification above. During use, the multiple of assemblies is connectable to a riser by at least one suitable riser tensioning cable, for example, made of wire or fiber rope. The pressure supplied to the second cylinder chamber via the high pressure fluid reservoir is automatically adjusted as a response to the riser induced force on the cylinder piston caused by the movement of the floating platform, thereby providing an approximately geostationary riser positioning. At least one of the individually operated hydraulic cylinder assemblies can, for example, comprise at least two hydraulic cylinder units in accordance with the specification above.

In the following description, numerous specific details are introduced to provide a thorough understanding of embodiments of the claimed apparatus and method. A skilled person in the relevant art will, however, recognize that these embodiments can be practiced without one or more of the specific details, or with other components, systems, etc. In other instances, well-known structures or operations are not shown, or are not described in detail, to avoid obscuring aspects of the disclosed embodiments.

FIG. 1 shows a perspective view of a wire line riser tensioning system 30 in accordance with the prior art, comprising in total eight hydraulic cylinder assemblies 200 or tensioner units (corresponding to at total of sixteen hydraulic cylinder units) providing radial symmetric tension to a marine riser 40. In this particular embodiment, each of the hydraulic cylinder assemblies 200 has two hydraulic cylinder units 100 arranged between two pairs of sheaves 3,4 through which a set of riser tensioning cables 15 (wire cable or other flexible tensioning line) having properties suitable for the particular application is guided in order to improve force and length exchange within the system as well as to provide reliable cable guiding. In FIG. 1, the set of riser tensioning cables 15 is introduced at the upper pair of first sheave 3 and is exited at the lower pair of second sheaves 4. To each set of riser tensioning cables 15, there is additionally arranged one or more third sheaves or turndown sheaves 41 to further improve the force exchange, as well as to reorientate the riser tensioning cables 15 in a direction towards a riser tensioning ring 45 secured around the riser 40 in question, onto which ring 45 the riser tensioning cables 15 are connected. During use, any movements of the floating platform (not shown) at which the wire line riser tensioning system 30 is mounted creates a force on the riser 40 which (via the attached riser tensioning ring 45) results in a cable tension that corresponds to the force on the cylinder piston 2 in the pressurized hydraulic cylinder 1. For example, if the platform or vessel heaves upwardly, the tension in the set of riser tensioning cables 15 forces the cylinder piston 2 downward which, in turn, forces the high pressure hydraulic fluid out of the lower end 1" of the hydraulic cylinder 1 and into the high-pressure accumulator 5 (see FIGS. 2-4). Conversely, if the platform or vessel heaves downward, the high-pressure accumulator 5 forces additional hydraulic fluid into the lower end 1" of the hydraulic cylinder 1, thereby forcing the cylinder piston 2 upward to maintain tension in the set of riser tensioning cables 15. The result is close to a geostationary riser positioning of the riser 40. The formulation "close to" signifies any movement of the riser considered to be within an acceptable range for continuous operation.

These types of wire line riser tensioning systems are currently manufactured for a large range of engineering loads. Typical capacities for each hydraulic cylinder assembly are 100 kip, 125 kip, 160 kip, 200 kip, 225 kip, 250 kip and 285 kip, corresponding to 445 kN, 556 kN, 712 kN, 890 kN, 1001 kN, 1112 kN and 1268 kN expressed in SI units, and typical number of hydraulic cylinder assemblies in a tensioning system is eight, twelve or sixteen.

In order to allow a particular tension to a riser, a system constituting a number of assemblies having a certain engineering load (for example, eight assemblies times 100 kip (445 kN)) may in principle be combined with another wire line tensioning system having a different configuration (for example, eight times 250 kips (1112 kN)). In practice, however, such a combination of systems is never implemented.

The size and the number are generally chosen based on the maximum design requirements. For example, if one chooses a system having sixteen times 225 kips (1001 kN), the user is in effect restricted to the resulting capacity of that particular size throughout the system's entire lifetime. To reduce the number of applied cylinders has proven to be impractical since it would necessitate entering the moonpool in open sea to disconnect riser tensioning cables. In addition to being both time-consuming and costly, a solution which involves letting some of the cables be suspended unsupported inside the moonpool is considered highly undesirable due to the increased risk of damaging the surrounding equipment and the actual cables.

Figure 2:
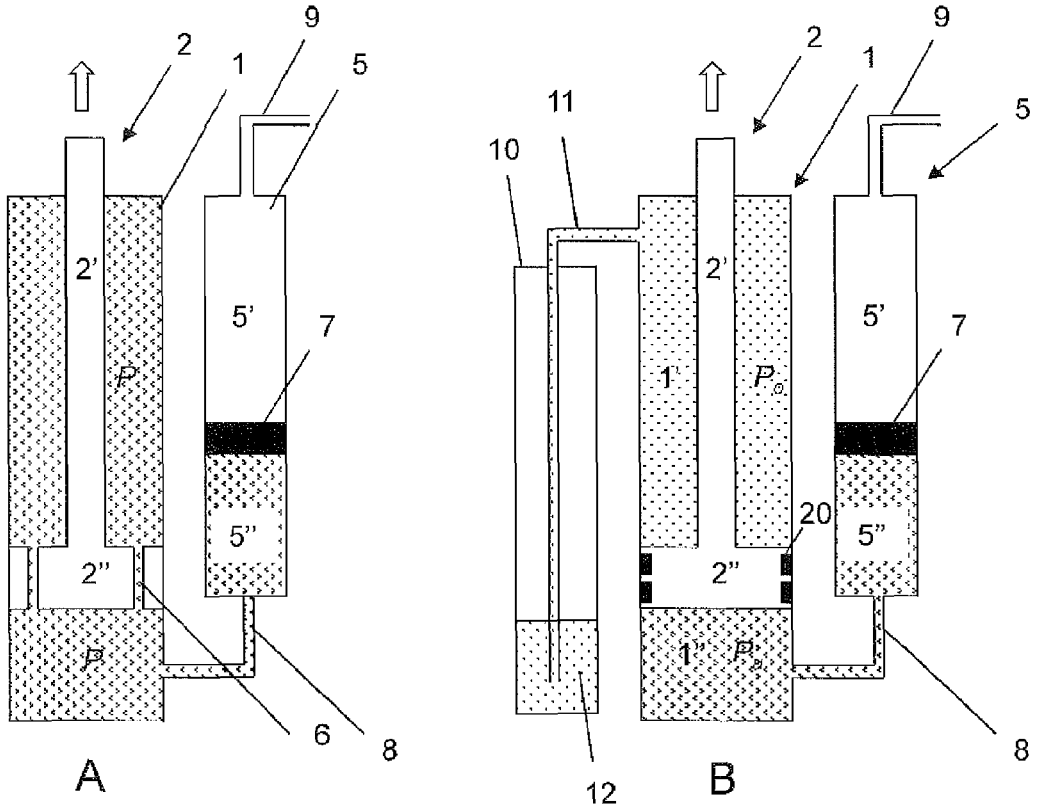
Fig. 2 (PRIOR ART)
FIG. 2 shows two sectional views of hydraulic cylinder units of type plunger and dual acting, respectively, in accordance with the prior art.

The FIGS. 2 A and B shows sectional views of a hydraulic cylinder unit 100 forming part of the above mentioned hydraulic cylinder assembly 200 for the plunger type and the dual acting type, respectively. More specifically, the cylinder or barrel 1 illustrated in FIG. 2 is set in fluid communication at its lower end (piston head side) with a high-pressure accumulator 5, which in turn is pressurized by a suitable gas bank (not shown). The high-pressure accumulator 5 further comprises in this particular embodiment a floating piston 7 which is slidingly journaled within the high-pressure accumulator 5, thereby dividing the high-pressure accumulator 5 into a high pressure gas end 5' and high pressure fluid end 5". A relatively high pressure gas (e.g., nitrogen or dry air between 2000-2500 psi) is supplied from the gas bank to the high pressure gas end 5' of the high-pressure accumulator 5 via a high pressure gas conduit 9, thereby driving the hydraulic fluid situated in the high pressure fluid end 5" towards the lower end or piston head side 1" of the cylinder 1. As a result, the cylinder piston 2 is pushed upwardly in the cylinder 1, thus providing the desired tensioning of the riser 40 in question. To render the translational movement of the piston 2 possible, it is essential in the particular prior art arrangement shown in FIG. 2 A that fluids arranged on each side of the piston head 2" can flow freely between the two cylinder chambers 1',1". The piston head 2" should therefore be composed of one or more through-going perforations 6 to provide the desired fluid communication and thus pressure equalization, indicated in FIG. 2 A with the letter P.

The hydraulic cylinder unit shown in FIG. 2 B (dual acting) is configured in a similar way as that shown in FIG. 2 A (plunger). The principle configuration of dual acting compared to plunger differs, however, in two essential ways:

- there is no fluid communication between the first cylinder chamber (piston rod side) 1' and the second cylinder chamber (piston head side) 1", and
- in addition to the fluid communicating high-pressure accumulator 5 attached on the cylinders 1 lower end (piston head side 1"), the upper end (piston rod side 1') is set in fluid communication with a low pressure tank 10 via a first conduit or low pressure fluid conduit 11.

The consequence of the former differing feature is, inter alia, that, since there are no possibilities for pressure equalization across the piston head 2", a low pressure zone and a high pressure zone is established within the first cylinder chamber 1' and second cylinder chamber 1", respectively. The consequence of the latter differing feature is further that a pressure in the first cylinder chamber 1' equals the prevailing pressure in the low pressure tank 10, or in the part of the low pressure tank 10, that is in direct fluid communication with the first cylinder chamber 1'. In FIG. 2 B, the low pressure tank 10 is illustrated as a cylinder partly filled with a tank fluid 12 into which the free end of the low pressure fluid conduit 11 is inserted. Also illustrated in FIG. 2 B are piston seals 20 arranged on the circumference of the piston head 2" to allow fluid tight translational movements along the inner walls of the cylinder 1. There is normally no need for internal lubrication of the piston head 2" since the hydraulic fluid filling the cylinder 1 allows for adequate lubrication. Other embodiments, including dedicated piston lubrication, may, however, be provided.

Figure 3:
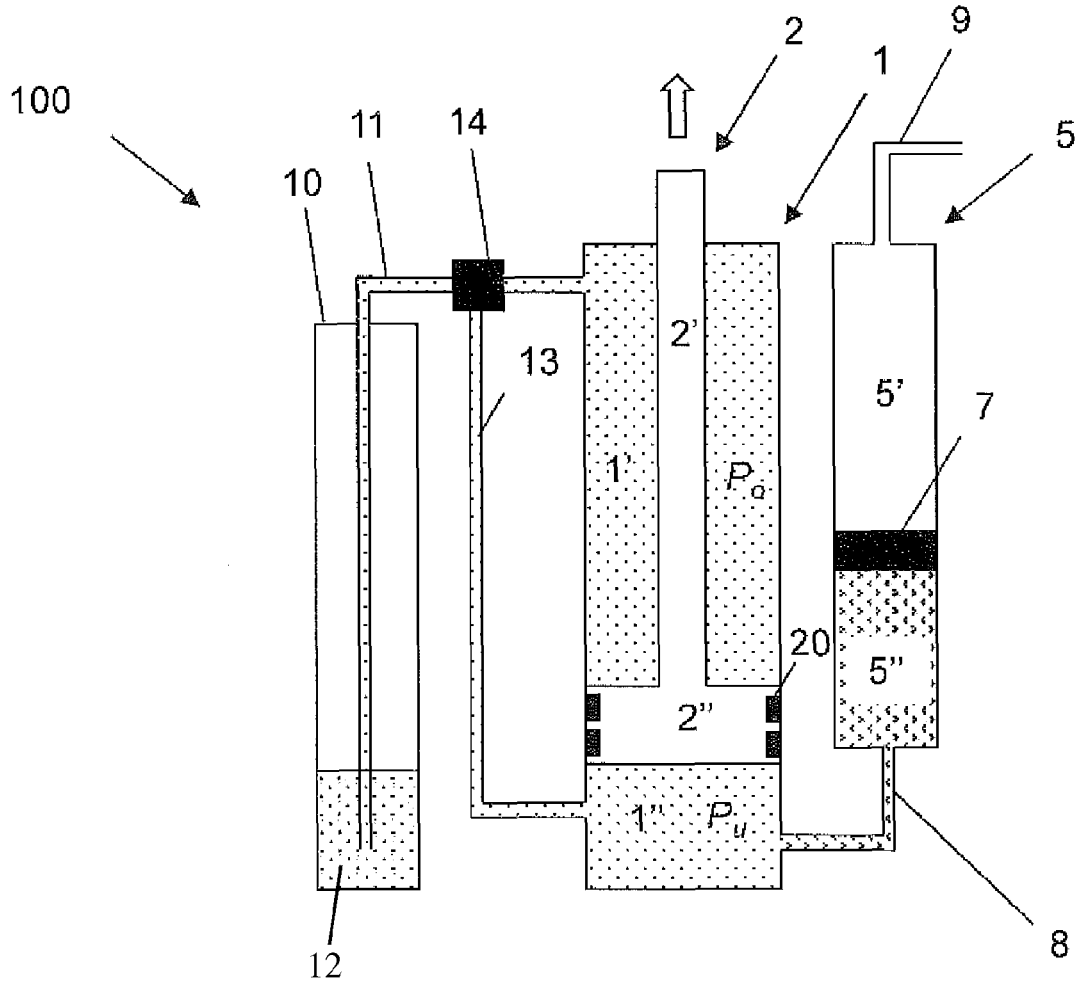
FIG. 3 shows a sectional view of a hydraulic cylinder unit with multi capacity properties in accordance with the present invention.
Figure 4:
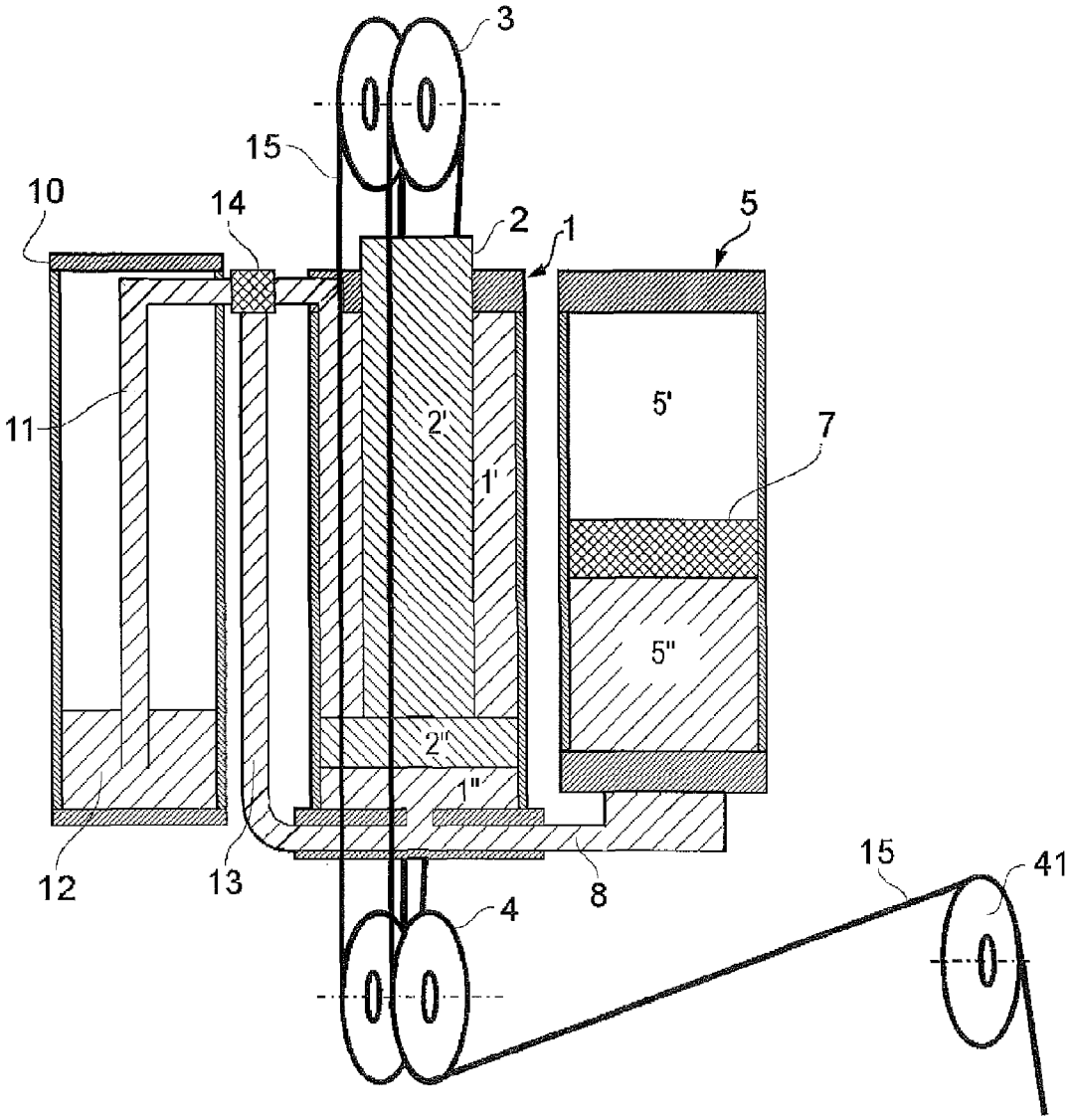
FIG. 4 shows a sectional view of an inventive hydraulic cylinder unit of the type illustrated in FIG. 3 with attached sheaves for receiving riser tensioning cables.

FIG. 3 shows the hydraulic cylinder unit 100 in accordance with the present invention in which the principles of the hydraulic cylinder unit illustrated in FIG. 2 A and the principles of the hydraulic cylinder unit illustrated in FIG. 2 B have been combined. The cylinder or barrel 1 shown in FIG. 3 is, in a way similar as the solution seen in both FIG. 2 A and FIG. 2 B, set in fluid communication at its lower end 1" (piston head side) with a high-pressure accumulator 5 by the use of a second conduit or high pressure fluid conduit 8. The high-pressure accumulator 5 is pressurized by a suitable gas bank (not shown), normally by an additional high pressure gas conduit 9 arranged at the opposite axial end of the high-pressure accumulator 5 relative to the high pressure fluid conduit 8. As for the solution seen in FIG. 2 B, the upper end (piston rod side) 1' of the cylinder 1 is further set in fluid communication with a low pressure tank 10 by the use of a first conduit or low pressure fluid conduit 11.

In this particular embodiment, the high-pressure accumulator 5 comprises a floating piston 7 slidingly journaled therein which divides the high-pressure accumulator 5 into a high pressure gas end 5' and high pressure fluid end 5". A gas, for example, nitrogen or dry air, is applied at a relatively high pressure (e.g., between 2000-2500 psi) from the gas bank to the high pressure gas end 5' of the high-pressure accumulator 5, thereby driving the hydraulic fluid arranged in the high pressure fluid end 5" through the high pressure fluid conduit 8 and towards the piston head side of the piston 2. The result is an upward movement of the piston 2 within the cylinder 1, providing the desired tensioning of the riser 40 via the corresponding riser tensioning cable 15. Note that the pressure from the gas bank may vary significantly from the above indicated range. A typical upper load range of riser tensioning systems is currently about 3000 psi. Higher load ranges of, for example, 4000-5000 psi are also envisaged. The minimum pressure may also be a few hundred psi, for example, 200 psi.

The piston head 2", dividing the cylinder chamber 1 into the first cylinder chamber (piston rod side) 1' and the second cylinder chamber (piston head side) 1" is designed to sustain a fluid tight separation between the two chambers 1',1", for example, by arranging one or more seals 20 on the circumference of the piston head 2" to allow for a continued contact with the inner wall of the cylinder 1 during piston sliding.

The upper end (piston rod side) 1' is set in fluid communication with the low pressure tank 10 by the low pressure fluid conduit 11. In FIG. 3, the low pressure tank 10 is illustrated as a cylinder partly filled with a tank fluid 12 into which the free end of the low pressure fluid conduit 11 is inserted. A skilled person would, however, understand that any low pressure tank having the desired (or the ability to establish the desired) pressure may also be used.

The configuration of the assembly in FIG. 3 differs from the hydraulic cylinder units shown in FIGS. 2 A and B in two principle ways:

- a feedback conduit 13 is arranged to provide a fluid communication element between the first cylinder chamber 1' (here via the low pressure fluid conduit 11) and the second cylinder chamber 1", and
- one or more valves 14 are arranged in the feedback conduit 13 (here situated between the feedback conduit 13 and the low pressure fluid conduit 11) to render reversible switching between the following alternative modes possible:
  - to allow fluid flow from the low pressure tank 10 to the first cylinder chamber 1' (here via the low pressure fluid conduit 11) while preventing fluid flow from the first cylinder chamber 1' to the second cylinder chamber 1", and
  - to allow fluid flow from the first cylinder chamber 1' to the second cylinder chamber 1" via the feedback conduit 13 while preventing fluid flow from the low pressure tank 10 to the first cylinder chamber 1'.

Reversible switching between the two intrinsic capacity potentials of the two individual systems plunger (FIG. 2 A) and dual acting (FIG. 2 B) is thus achieved.

The application of pressure from the high-pressure accumulator 5, as well as fluid pressure from the low pressure tank 10, may be controlled by conventional control mechanisms such as valves (not shown) operated from a platform/vessel deck situated control panel. Over-pressure relief for the high-pressure accumulator 5 and the low pressure tank 10 may also be provided by conventional "pop-off" pressure relief valves (not shown), as is well-known in the art.

In a system of riser tensioners, the two longitudinal ends of each cylinder 1 are both typically equipped with assemblies of sheaves 3,4. In the particular embodiment shown in FIGS. 4 and 1, two pair of sheaves are applied, resulting in a transmission ratio of 1:4 relative to the wire force, and a 4:1 transmission ratio of the wire length. A typical dimension used in the industry is a cylinder of length 3.8 meter, having an approximately 15 meter wire travel length.

In the preceding description, various aspects of the apparatus according to the present invention have been described with reference to the embodiment shown in the drawings. For purposes of explanation, specific numbers, systems and configurations are set forth in order to provide a thorough understanding of the apparatus and its workings. This description is not, however, intended to be construed in a limiting sense. Various modifications and variations of the illustrative embodiment, as well as other embodiments of the apparatus, which are apparent to persons skilled in the art to which the disclosed subject matter pertains, are deemed to lie within the scope of the present invention. Reference should also be had to the appended claims.

LIST OF REFERENCE NUMERALS

1 Hydraulic cylinder/cylinder/barrel
1' First cylinder chamber/piston rod side/upper end
1" Second cylinder chamber/piston head side/lower end
2 Cylinder piston/piston
2' Piston rod
2" Piston head
3 First sheave/upper sheave
4 Second sheave/lower sheave
5 High-pressure accumulator/high-pressure fluid reservoir
5' High pressure gas end
5" High pressure fluid end
6 Piston perforation/through perforation
7 Reservoir piston/floating piston
8 Second conduit/high pressure conduit/high pressure fluid conduit
9 High pressure gas conduit
10 Low pressure tank/low pressure accumulator tank
11 First conduit/low pressure conduit/low pressure fluid conduit
12 Tank fluid
13 Feedback conduit
14 Valve/valve element
15 Riser tensioning cable
20 Piston seals
30 Wire line riser tensioning system
40 Riser
41 Third sheave/turndown sheave
45 Riser tensioning ring
100 Hydraulic cylinder unit
200 Hydraulic cylinder assembly

What is claimed is:

1. A hydraulic cylinder unit for connection to a wire line riser tensioner system, the hydraulic cylinder unit comprising:

- a hydraulic cylinder comprising a first cylinder chamber, a second cylinder chamber and at least one cylinder piston arranged to separate the first cylinder chamber from the second cylinder chamber, the at least one cylinder piston comprising a piston rod and a piston head;
- a low pressure tank arranged as a closed cylinder so as to comprise a desired pressure;
- at least one first conduit inserted into the closed cylinder of the low pressure tank and configured to provide a fluid communication between the low pressure tank and the first cylinder chamber;
- a high pressure fluid reservoir;
- at least one second conduit configured to provide a fluid communication between the high pressure fluid reservoir and the second cylinder chamber;
- at least one feedback conduit configured to provide a direct fluid communication between the first cylinder chamber and the second cylinder chamber;
- a valve element comprising at least one valve, the valve element being configured to be in a fluid communication with the at least one first conduit and the at least one feedback conduit, the valve element being configured to provide a reversible switching between either,
  - a first configuration comprising a first fluid obstruction between the low pressure tank and the first cylinder chamber, and a first fluid communication between the first cylinder chamber and the second cylinder chamber via the at least one feedback conduit, and a second configuration comprising a second fluid obstruction between the first cylinder chamber and the second cylinder chamber, and a second fluid communication between the low pressure tank and the first cylinder chamber via the at least one first conduit;

at least one first sheave arranged at a first axial side of the first cylinder chamber; and at least one second sheave arranged at a second axial side of the first cylinder chamber, wherein, the wire line riser tensioner system comprises a riser tensioning cable and a riser, the riser tensioning cable being connectable to an end of the riser, and the at least one first sheave and the at least one second sheave are each configured to receive the riser tensioning cable during a use of the wire line riser tensioner system.

2. The hydraulic cylinder unit as recited in claim 1, wherein at least one of the at least one valve is arranged in the at least one first conduit.

3. The hydraulic cylinder unit as recited in claim 1, wherein the at least one valve is a three-way valve.

4. The hydraulic cylinder unit as recited in claim 1, wherein, at least one of the at least one valve is arranged so as to be in a fluid communication on the at least one first conduit, and at least one of the at least one valve is arranged so as to be in a fluid communication on the at least one feedback conduit.

5. The hydraulic cylinder unit as recited in claim 1, wherein the piston rod is arranged in the first cylinder chamber.

6. The hydraulic cylinder unit as recited in claim 1, further comprising:

at least two first sheaves each being arranged at a first axial side of the first cylinder chamber; and at least two second sheaves each being arranged at a second axial side of the first cylinder chamber;

wherein, the wire line riser tensioner system comprises riser tensioning cables and a riser, each of the riser tensioning cables being connectable to an end of the riser, and the at least two first sheaves and the at least two second sheaves are each configured to receive one of the riser tensioning cables during a use of the wire line riser tensioner system.

7. The hydraulic cylinder unit as recited in claim 1, wherein, the high pressure fluid reservoir comprises a high pressure gas end, a high pressure fluid end and a reservoir piston arranged to separate the high pressure gas end from the high pressure fluid end, and the high pressure fluid end is arranged so as to be in a fluid communication with the second cylinder chamber via the at least one second conduit.

8. The hydraulic cylinder unit as recited in claim 7, wherein the reservoir piston is a floating piston.

9. A method for switching a hydraulic cylinder unit from a low tension capability to a high tension capability, the method comprising:

providing the hydraulic cylinder unit as recited in claim 1;

operating the valve element to prohibit a fluid communication between the first cylinder chamber and the second cylinder chamber; and simultaneously, allowing a fluid communication between the first cylinder chamber and the low pressure tank.

10. A wire line riser tensioning system for a riser connected to a floating platform, the wire line riser tensioning system comprising:

a plurality of individually operated hydraulic cylinder assemblies each comprising at least one hydraulic cylinder unit as recited in claim 1; and at least one riser tensioning cable, wherein, the plurality of individually operated hydraulic cylinder assemblies are connected to the riser via the at least one riser tensioning cable during a use, the high pressure fluid reservoir is configured to automatically supply a pressure to the second cylinder chamber which is adjusted in response to a riser induced force on the cylinder piston caused by a movement of the floating platform so as to provide an approximately geostationary riser positioning of the floating platform.

11. The wire line riser tensioning system as recited in claim 10, wherein at least one of the plurality of individually operated hydraulic cylinder assemblies comprises at least two hydraulic cylinder units.

12. A method for switching a hydraulic cylinder unit from a high tension capability to a low tension capability, the method comprising:

providing the hydraulic cylinder unit as recited in claim 1;

operating the valve element in the hydraulic cylinder unit so as to allow a fluid communication between the first cylinder chamber and the second cylinder chamber via the at least one feedback conduit; and simultaneously, prohibiting a fluid communication between the first cylinder chamber and the low pressure tank.

* * * * *